US005261656A

United States Patent [19]

Gutov et al.

[11] Patent Number: 5,261,656

[45] Date of Patent: Nov. 16, 1993

[54] DEVICE FOR RECEIVING PRINTED PRODUCTS FROM A PRODUCT FOLDING APPARATUS OF A REVOLVINGLY DRIVEN MACHINE

[76] Inventors: Sergei K. Gutov, ulitsa Ramenka, 7, korpus 1, kv. 76; Dmitry A. Plesser, ulitsa Seleznevskaya, 30, korpus 3, kv. 14; Grigory A. Radutsky, ulitsa Pervomaiskaya 66, kv. 45, all of Moscow, U.S.S.R.

[21] Appl. No.: 849,079

[22] PCT Filed: Aug. 5, 1991

[86] PCT No.: PCT/SU91/00162

§ 371 Date: Apr. 28, 1992

§ 102(e) Date: Apr. 28, 1992

[87] PCT Pub. No.: WO92/02442

PCT Pub. Date: Feb. 20, 1992

[30] Foreign Application Priority Data

Aug. 6, 1990 [SU] U.S.S.R. ..... 4849904

[51] Int. Cl.[5] ..... B65H 5/02

[52] U.S. Cl. ..... 271/243; 271/187; 271/204

[58] Field of Search ..... 271/204, 206, 187, 243

[56] References Cited

U.S. PATENT DOCUMENTS

| | | | |
|---|---|---|---|
| 3,847,384 | 11/1974 | Bethke . | |
| 4,424,965 | 1/1984 | Faltin | 271/204 X |
| 4,565,363 | 1/1986 | Faltin | 271/243 X |
| 4,861,019 | 8/1989 | Michalik . | |
| 4,886,264 | 12/1989 | Haensch . | |
| 5,178,262 | 1/1993 | Merkli | 271/204 X |

FOREIGN PATENT DOCUMENTS 0265735 5/1988 European Pat. Off. .

*Primary Examiner*—Richard A. Schacher
*Attorney, Agent, or Firm*—Keck, Mahin & Cate

[57] ABSTRACT

At every chain (4) of the chain conveyor (3), there are arranged a vane element (6) and a clamp member (7) in the shape of a double arm lever, one arm of which affords engagement with the vane element (6), while another's roller (11) moves on/off a cam or pattern-copy-device (13) along the path of the chain (4) travel next to the product folding apparatus. Between the clamp member (7) and the vane element (6) a compartment or pocket (15) is formed to receive the printed product (1). As the chain (4) continues its movement, the roller (11) engaged with the cam (13) bears upon the element (7), and thereby the printed product (1) is held and the by-the-piece conveyance of the printed products is ensured.

2 Claims, 2 Drawing Sheets

DEVICE FOR RECEIVING PRINTED PRODUCTS FROM A PRODUCT FOLDING APPARATUS OF A REVOLVINGLY DRIVEN MACHINE

FIELD OF THE INVENTION

The invention relates to polygraphy equipment, and more specifically it relates to the devices for receiving printed products from a product folding apparatus of a revolvingly driven machine.

DESCRIPTION OF THE PRIOR ART

The devices for receiving printed products from a product folding apparatus of a revolvingly driven machine afford taking-over and conveying folded printed products to the handling locations or stations, to make batches or sheaves of the printed (newspaper) products.

A device of this type that is known, for instance, from U.S. Pat. No. 4,767,112, affords the by-the-piece reception of the folded products. This comprises an endless chain conveyor, and a plurality of extensions or arms, each arm having a gripper member or element. Arranged at a fixed mutual spacing from one another at the chain conveyor, these arms protrude beyond the conveying chains in a transverse direction. The printed products that are released from the folding apparatus are clamped one at a time by means of the gripper elements just beneath or downstream of the product folding apparatus, where the printed products move at a high velocity. In such a device, it is necessary to ensure exact coordination/matching of the gripper movement velocities, and, accordingly, of the speed of the conveying chain, and of the folded product ejection rate. Changes in the rotational velocity of the conveyor in relation to the given speed can bring damage to or result in skipping the printed products received from the product folding apparatus. Considering the high conveying velocity of the products released, as mentioned, from the product folding apparatus, it will be seen that this device is rather complicated in construction and design, and it is subject to malfunction.

Another known device affords by-the-piece clamping or retaining the folded printed products by means of a stripper element or an ejector, with subsequent transfer of the same to the belt or band conveyor, in order to form a "cascade" of the printed products.

One such device is known, for instance, from U.S. Pat. No. 4,861,019, comprising a stripper element, with the help of which the printed products are dropped or inserted into the printed products ejector pockets or compartments created between the said stripper elements and the clips or clamp members, for instance, in the form of a rubber plate. The spacing from one another between the stripper elements rigidly connected with the shaft mounted cam discs or cam rolls of the ejector, and the rubber plates, corners of which are affixed to chain links or members driven by the shaft mounted sprocket wheel, is adjusted, depending on the volume of the printed products, by pulling away or deflecting the whole chain, or drawing it nearer to the stripper elements.

In this case, the printed products are delivered by the ejector at a much lower speed than the product folding apparatus release velocity, thus making the operation more reliable.

However, though the above device obtains an advantage over the prior art U.S. Pat. No. 4,767,112, it suffers drawbacks or shortcomings because it contemplates "cascade" conveyance of the printed products that are delivered one after another. It is known that such conveyance substantially complicates subsequent counting and forming the printed products in batches and sheaves.

Thus, it will be noted that the prior art contains no means of the by-the-piece printed products reception that would be simple in construction and design, and convenient and reliable in operation.

SUMMARY OF THE INVENTION

It is a primary object of the present invention to provide a device for receiving the printed products from a product folding apparatus of a revolvingly driven machine, in order to ensure the delivery of the products (newspapers) with deceleration or slowing down the operation, and the subsequent by-the-piece conveyance of the printed products.

The object is accomplished by that in the device comprising a sprocket wheel of the endless chain conveyor, that carries clamp members or clips brought into engagement with the ejecting vane elements to allow insertion and clamping or seizure of the printed products, as the chain conveyor continues to operate, every link or chain of the chain conveyor is equipped, according to the invention, with an ejecting vane element and a clip or a clamping member. The conveyor's sprocket wheel is rotatably mounted at the driving shaft which also carries substantially parallel cam discs or rolls which terminate in a wedge-shaped configuration arranged at a fixed mutual spacing from one another, and corresponding to the intervals existing between the vane elements at the adjacent chains. Due to the preselectable position of each clamping member, there can be established the possibility of its displacement in relation to the vane element, aligned with the base of the relevant vane element; and each clip is positioned accordingly to allow such displacement in relation to the vane element.

There is thus ensured the by-the-piece reception of the folded printed products, taking after the prior art devices for receiving the printed products from a product folding apparatus; moreover, by virtue of the present invention, the printed (newspapers) products received are also conveyed piece by piece to the handling locations or stations, which makes counting and forming the printed products in batches and sheaves quite simple. The chain conveyor, in this case, could be of any length. With the aforementioned relevant position of the cam discs, the printed products are bound to fall into the pocket between the vane element and the clips, rendering canting or imbricated formation impossible.

BRIEF DESCRIPTION OF THE DRAWINGS

The present invention will be better understood when consideration is given to the following detailed description of the embodiment, without limiting the invention thereto, with reference to the accompanying drawings, wherein.

BEST MODE FOR CARRYING OUT THE INVENTION

Figure 1:
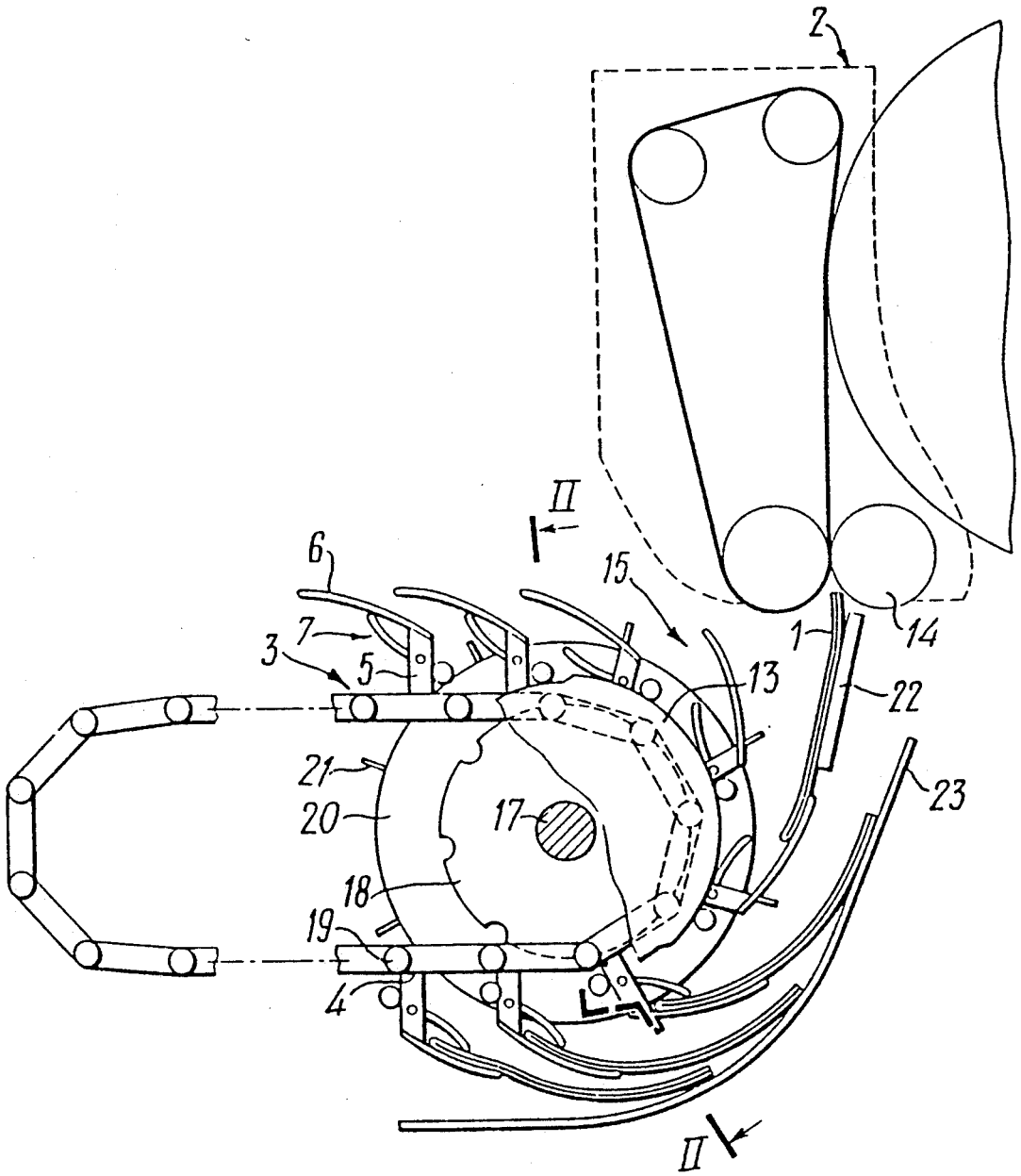
FIG. 1 schematically depicts the device for receiving the printed products, with the component of the endless chain conveyor shown by arbitrary symbols.
Figure 3:
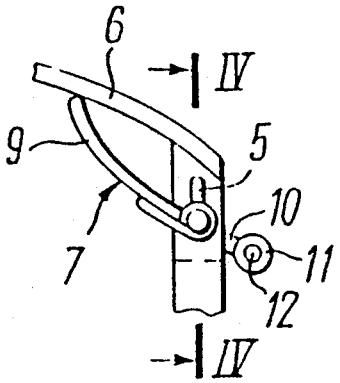
FIG. 3 illustrates a chain member with a clip and a stripper element affixed thereto.
Figure 4:
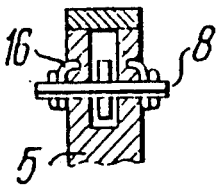
FIG. 4 is a sectional view taken along line IV—IV in FIG. 3.

As will be evident by inspecting FIG. 1, the device for receiving the printed products (or newspapers) 1 from a suitable and for that reason not particularly illustrated product folding apparatus 2 of a revolvingly driven machine (not shown to avoid overcrowded portrayal), comprises an endless chain conveyor 3, every chain member or link 4 of which conveyor supports a cantilever 5. This cantilever carries a vane element 6 (FIGS. 1 and 3), and a clamping member or clip 7 in the shape of a double arm lever connected to the cantilever 5 by an axle 8 (FIG. 4). One arm 9 (FIGS. 1 and 3) of this lever affords engagement with the vane element 6 in order to clamp the newspapers, while another arm 10 interacts with a stationary cam (a pattern-copy-device) 13 (FIG. 2) by means of a roller 11 arranged at an axle 12. This cam 13 (FIG. 1) is positioned at a location where the chain conveyor 3 is having a transport plane from the entrance under a folding roller 14 of the product folding apparatus 2 to the exit from beneath the folding roller 14. The profile or curvature of the cam 13 is such that as the roller 11 travels along the same, the arm 9 of the clip 7 recedes, thus creating a pocket 15 receiving the newspapers 1 released from the folding rollers 14. To increase retention, the arm 9 is pressed against the vane element 6 by means of a spring 16 (FIG. 4).

The chain conveyor 3 (FIG. 1) driven by the driving shaft 17, is operated by means of the sprocket wheel 18 which is rigidly connected with the shaft 17, and brought into engagement with the rollers 19. These rollers 19 have the flexible chains 4 gearing or transmission of the chain conveyor 3.

Figure 2:
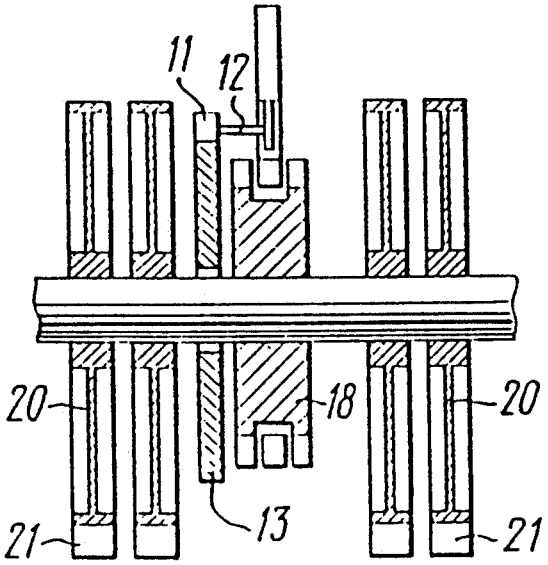
FIG. 2 is a sectional view taken along line II—II in FIG. 1.

As will be best observed in FIG. 2, at the same shaft 17 there are rigidly fixed discs 20 having the radial stops 21 designed to support the margins or edges of the printed products 1 supplied from the product folding apparatus 2. The spacing between the vane elements 6 corresponds to that existing between the radial cams 21, so that when the pocket 15 is fully open, the said radial cams fall into one line with the base of the vane elements 6.

A folding revolver 24 (shown schematically) of the product folding apparatus 2 and the driving shaft 17 are connected kinematically, so that when the folding revolver makes a 180 degrees turn, which corresponds to an issue or release of one newspaper, the shaft 5 rotates to such an angle of rotation as is necessary to bring the next pocket 15 under the folding roll.

Along the path of the newspapers movement, downstream of the product folding apparatus the entrainment elements or arrangements 22 and 23 are arranged.

The device according to the invention operates as follows:

The chain 4 of the chain conveyor 3 approaching the product folding apparatus 2, the roller 11 drives on the cam 13, and the arm 9 of the clamp 7 gradually deflects or moves away from the vane element 6, as a result of which the pocket 15 is formed. Synchronously the cam discs 20 make a turn, and at the moment when the pocket is below the folding rolls 14, the stop members 21 possessed by the discs 20 fall into one line with the base of the vane element 6. The newspapers 1 are smoothly conveyed along the entrainment arrangement 22 and the vane element 6, into the pocket 15. As the shaft 17 continues to rotate, the roller 11 drives off the curvature or profile of the cam 13, as a result of which the arm 9 of the clamp member 7 retains the newspapers 1 at the vane element 6, thereby fixing its position. The free edge of the newspaper slides on the entrainment arrangement 23. Now, the newspaper 1 is fixedly held or retained at the chain 4 location by the vane element 6 and the arm 9 of the clamp 7, and there is thus ensured the by-the-piece conveyance of the newspapers to their handling locations or stations.

OPERATION

A device for receiving the printed products from a product folding apparatus of a revolvingly driven machine is intended for the by-the-piece conveyance of newspapers to the handling stateions, where the printed products are placed in batches and sheaves. The devices according to the invention can be easily adjusted to any kind of the operational equipment.

We claim:

1. A device for receiving printed products from a product folding apparatus (2) of a revolvingly driven machine, comprising a sprocket wheel (18) of an endless chain conveyor (3) carrying clamp members (7) brought into engagement with ejecting vane elements (6) to hold the printed products (1) conveyed along the path of travel maintained by the chain conveyor, wherein the clamp members (7) and the vane elements (6) are fixedly arranged in pairs at every chain (4) of the chain conveyor (3), a sprocket wheel (18) of said conveyor is rotatably mounted at shaft (17) which also carries substantially parallel discs (20) equipped with the stop members (21), arranged at a fixed mutual spacing according to the spacing between the vane elements (6) of the adjacent chains (4) and placed at the product outfeed location in line with the base of the vane element (6), while every clamp member (7) is positioned to provide a possibility of deflection in relation to the vane element (6).

2. A device according to claim 1, wherein the clamping members (7) comprise resilient double arm levers, wherein one arm (9) of every such lever is brought into engagement with the vane element (6), while another arm (10) affords engagement with a cam 13.

* * * * *